US007055735B1

(12) United States Patent
Captain et al.

(10) Patent No.: US 7,055,735 B1
(45) Date of Patent: Jun. 6, 2006

(54) ADAPTABLE MAILBOX MOUNTING CONFIGURATION

(75) Inventors: Judy Captain, Long Beach, WA (US); James C. Hogan, Heisson, WA (US); Kathy Williams, Naselle, WA (US)

(73) Assignee: Kay Jay Novelties, LLC, Long Beach, WA (US)

( * ) Notice: Subject to any disclaimer, the term of this patent is extended or adjusted under 35 U.S.C. 154(b) by 76 days.

(21) Appl. No.: 10/665,786

(22) Filed: Sep. 17, 2003

(51) Int. Cl.
*B65D 91/00* (2006.01)

(52) U.S. Cl. ..... 232/34

(58) Field of Classification Search ..... 232/34, 232/35, 17; 116/173
See application file for complete search history.

(56) References Cited

U.S. PATENT DOCUMENTS 3,802,619 A * 4/1974 Vanderveer ..... 232/17
3,889,874 A * 6/1975 Arwood ..... 232/35
3,958,752 A 5/1976 Pieszchala
4,072,265 A 2/1978 Jones
4,113,170 A 9/1978 Hunsicker
4,147,292 A 4/1979 Fisher
4,158,430 A 6/1979 Wideman
4,182,479 A 1/1980 Swift
4,190,193 A 2/1980 Smith
4,201,334 A 5/1980 Janik
4,223,828 A 9/1980 Whitley et al.
4,316,575 A 2/1982 VanDarwarka
4,344,559 A 8/1982 Widham
4,365,740 A 12/1982 Whitley et al.
4,390,122 A 6/1983 Savko
4,449,663 A 5/1984 Schluter
4,454,981 A * 6/1984 Halmasy, Sr. ..... 232/1 C
4,552,302 A 11/1985 Rung
4,570,846 A 2/1986 Morgrey
4,697,733 A 10/1987 Todd
4,711,391 A 12/1987 Roge et al.
4,712,732 A 12/1987 Esopi
4,728,028 A 3/1988 Barnes et al.
4,738,392 A 4/1988 Kovacs
4,752,030 A 6/1988 Witt
4,756,472 A 7/1988 Hammons
4,759,496 A 7/1988 Swick
4,793,552 A 12/1988 Revels
4,805,834 A 2/1989 Saba
4,836,441 A 6/1989 Crider
4,953,783 A 9/1990 Chambers
4,978,057 A 12/1990 Roden
5,004,148 A 4/1991 Windrem
5,082,170 A 1/1992 Goss
5,092,517 A 3/1992 Jeffries, Jr. et al.
5,094,386 A 3/1992 Tabacco
5,123,590 A 6/1992 Teele
5,273,207 A 12/1993 Johnson
5,366,148 A 11/1994 Schreckengost
5,427,311 A 6/1995 Kachmar
5,445,317 A 8/1995 Sokolowski
5,595,341 A * 1/1997 Robinson et al. ..... 232/17
5,634,589 A 6/1997 Greene (Continued)

*Primary Examiner*—William L. Miller
(74) *Attorney, Agent, or Firm*—K. M. Rylander

(57) ABSTRACT

A mailbox signal flag mounting apparatus includes a stem having a mounting aperture, a detachable stop tab attached to said stem, and a detachable bushing attached to said stem. A replacement mailbox signal flag includes a stem having a mounting aperture, a detachable stop tab attached to said stem, a detachable bushing attached to said stem, and a flag portion attached to the distal end of said stem in relation to the mounting aperture.

3 Claims, 2 Drawing Sheets

U.S. PATENT DOCUMENTS 5,645,215 A * 7/1997 Marendt et al. ..... 232/17
5,865,368 A 2/1999 Taylor et al.
6,053,404 A 4/2000 Jefferson et al.
6,293,461 B1 * 9/2001 Rivers, Sr. ..... 232/35
6,371,367 B1 4/2002 Otero
6,425,521 B1 7/2002 Cooper
6,513,706 B1 2/2003 Kuca
6,575,357 B1 6/2003 Rundell

* cited by examiner 10
12
14
16
17
22
24
26
28
2
4

ADAPTABLE MAILBOX MOUNTING CONFIGURATION

FIELD OF THE INVENTION

The present invention relates to rural and curbside mailboxes. More particularly, the present invention relates to methods and apparatus for mounting mailbox flags to rural and curbside mailboxes.

BACKGROUND

Rural and curbside mailboxes are a common sight. The attached signal flag identifies when there is mail to pick up or has been delivered. Many mailbox manufacturers provide a means for the replacement of the carrier signal flag. This is desirable in the event that the flag is damaged or if a decorative aftermarket flag is to be installed. Although standards for sizes, shapes and operational requirements of mailboxes and, to a lesser degree carrier signal flags, are set by the U.S. Postal Service, the mechanism for the attachment of the flag to the mailbox is not defined or described in the standards. The only parameter is that the mechanism provides for conformance to the operational requirements. Therefore, most mailbox manufacturer's signal flag mounting mechanisms have one or more unique features. This is an inconvenience in that the consumer must contact the mailbox manufacturer to obtain an original equipment replacement flag and also in that a properly functioning decorative aftermarket flag may be eliminated as an option.

Thus, there is a need for a mailbox signal flag mounting apparatus that can be mounted to any of a number of different types of mailboxes. The following represents a list of known related art:

| Reference: | Issued to: | Date of Issue: |
|---|---|---|
| U.S. Pat. No. 6,575,357 | Rundell | Jun. 10, 2003 |
| U.S. Pat. No. 6,513,706 | Kuca | Feb. 4, 2003 |
| U.S. Pat. No. 6,425,521 | Cooper | Jul. 30, 2002 |
| U.S. Pat. No. 6,371,367 | Otero | Apr. 16, 2002 |
| U.S. Pat. No. 6,053,404 | Jefferson et al. | Apr. 25, 2000 |
| U.S. Pat. No. 5,865,368 | Taylor get al. | Feb. 2, 1999 |
| U.S. Pat. No. 5,634,589 | Greene | Jun. 3, 1997 |
| U.S. Pat. No. 5,445,317 | Sokolowski | Aug. 29, 1995 |
| U.S. Pat. No. 5,427,311 | Kachmar | Jun. 27, 1995 |
| U.S. Pat. No. 5,366,148 | Schreckengost | Nov. 22, 1994 |
| U.S. Pat. No. 5,273,207 | Johnson | Dec. 28, 1993 |
| U.S. Pat. No. 5,123,590 | Teele | Jun. 23, 1992 |
| U.S. Pat. No. 5,094,386 | Tabacco | Mar. 10, 1992 |
| U.S. Pat. No. 5,092,517 | Jeffries, Jr. et. al. | Mar. 3, 1992 |
| U.S. Pat. No. 5,082,170 | Goss | Jan. 21, 1992 |
| U.S. Pat. No. 5,004,148 | Windrem | Apr. 2, 1991 |
| U.S. Pat. No. 4,978,057 | Roden | Dec. 18, 1990 |
| U.S. Pat. No. 4,072,265 | Jones | Feb. 7, 1978 |
| U.S. Pat. No. 4,113,170 | Hunsicker | Sep. 12, 1978 |
| U.S. Pat. No. 4,953,783 | Chambers | Sep. 4, 1990 |
| U.S. Pat. No. 4,836,441 | Crider | Jun. 6, 1989 |
| U.S. Pat. No. 4,805,834 | Saba | Feb. 21, 1989 |
| U.S. Pat. No. 4,793,552 | Revels | Dec. 27, 1988 |
| U.S. Pat. No. 4,759,496 | Swick | Jul. 26, 1988 |
| U.S. Pat. No. 4,756,472 | Hammons | Jul. 12, 1988 |
| U.S. Pat. No. 4,752,030 | Witt | Jun. 21, 1988 |
| U.S. Pat. No. 4,738,392 | Kovacs | Apr. 19, 1988 |
| U.S. Pat. No. 4,728,028 | Barnes et. al. | Mar. 1, 1988 |
| U.S. Pat. No. 4,712,732 | Esopi | Dec. 15, 1987 |
| U.S. Pat. No. 4,711,391 | Roge et al. | Dec. 8, 1987 |
| U.S. Pat. No. 4,697,733 | Todd | Oct. 6, 1987 |
| U.S. Pat. No. 4,570,846 | Morgrey | Feb. 18, 1986 |

-continued

| Reference: | Issued to: | Date of Issue: |
|---|---|---|
| U.S. Pat. No. 4,552,302 | Rung | Nov. 12, 1985 |
| U.S. Pat. No. 4,449,663 | Schluter | May 22, 1984 |
| U.S. Pat. No. 4,390,122 | Savko | Jun. 28, 1983 |
| U.S. Pat. No. 4,365,740 | Whitley, et al. | Dec. 28, 1982 |
| U.S. Pat. No. 4,344,559 | Widham | Aug. 17, 1982 |
| U.S. Pat. No. 4,316,575 | VanDarwarka | Feb. 23, 1982 |
| U.S. Pat. No. 4,223,828 | Whitley et al. | Sep. 23, 1980 |
| U.S. Pat. No. 4,201,334 | Janik | May 6, 1980 |
| U.S. Pat. No. 4,190,193 | Smith | Feb. 26, 1980 |
| U.S. Pat. No. 4,182,479 | Swift | Jan. 8, 1980 |
| U.S. Pat. No. 4,158,430 | Wideman | Jun. 19,1979 |
| U.S. Pat. No. 4,147,292 | Fisher | Apr. 3, 1979 |
| U.S. Pat. No. 3,958,752 | Pieszchala | May 25, 1976 |

The teachings of each of the above-listed citations (which does not itself incorporate essential material by reference) are herein incorporated by reference. None of the above inventions and patents, taken either singularly or in combination, is seen to describe the instant invention as claimed.

SUMMARY AND ADVANTAGES

The mailbox signal flag mounting apparatus for mounting replacement signal flags on rural or curbside mailboxes of the present invention includes a stem having a mounting aperture, a detachable stop tab attached to said stem, and a detachable bushing attached to said stem. A replacement mailbox signal flag includes a stem having a mounting aperture, a detachable stop tab attached to said stem, a detachable bushing attached to said stem, and a flag portion attached to the distal end of said stem in relation to the mounting aperture.

The apparatus and signal flag of the present invention presents numerous advantages, including: (1) provides a mounting configuration that is adaptable to most rural and curbside mailboxes in which the manufacturer has provided a means to remove and replace the carrier signal flag; (2) provides a replacement flag that when installed complies with the U.S. Postal Service operational requirements; (3) adapts to unique features of individual mailbox manufacturer's carrier signal flag mounting designs; (4) provides for U.S. Postal Service compliant operation of aftermarket carrier signal flags; (7) provides an option other than relying on the mailbox manufacturer for obtaining a properly functioning replacement flag; (8) provides manufacturers of decorative aftermarket carrier signal flags a means of producing a flag that can be installed on a variety of manufacturer's mailboxes and be in compliance with U.S. Postal Service operational requirements; (9) helps reduce the number of non-compliant flags in use, thereby reducing the hazards and inconveniences to postal carriers.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figures 1, 2, 3, 4:
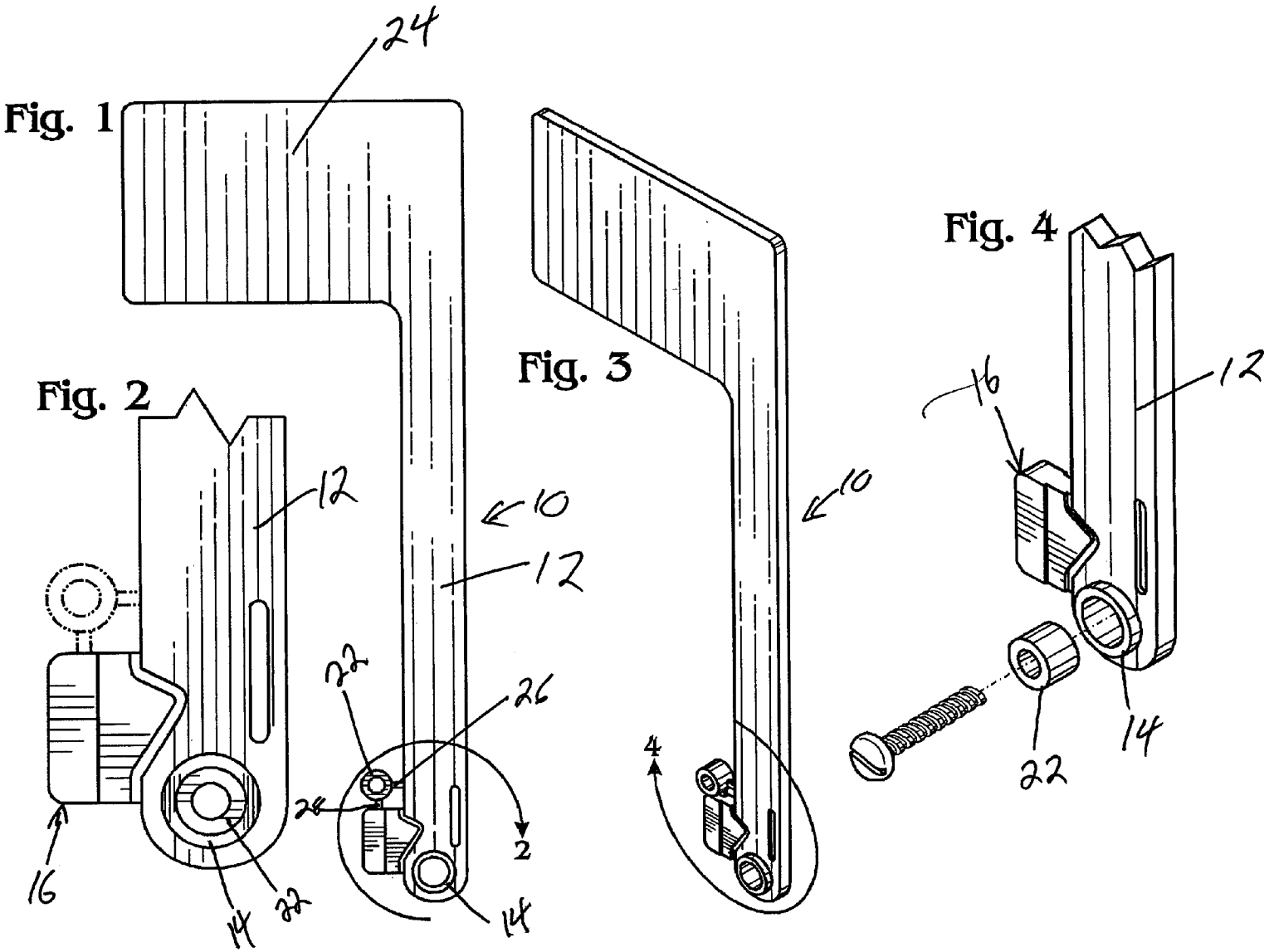
FIG. 1 shows an embodiment of the present invention.
FIG. 2 shows a view of FIG. 1.
FIG. 3 shows the embodiment of FIG. 1 from a perspective.
FIG. 4 shows an exploded view of a portion of FIG. 3.

As shown in FIGS. 1 and 3, a replacement mailbox signal flag 10 includes a flag portion 24 attached to one end of a stem 12, a mounting aperture 14 on the distal end of said stem in relation to the flag portion, a detachable stop tab 16 attached to said stem on the same end as the mounting aperture, and a detachable bushing 22 attached to said stem.

Figures 5, 6, 7, 8:
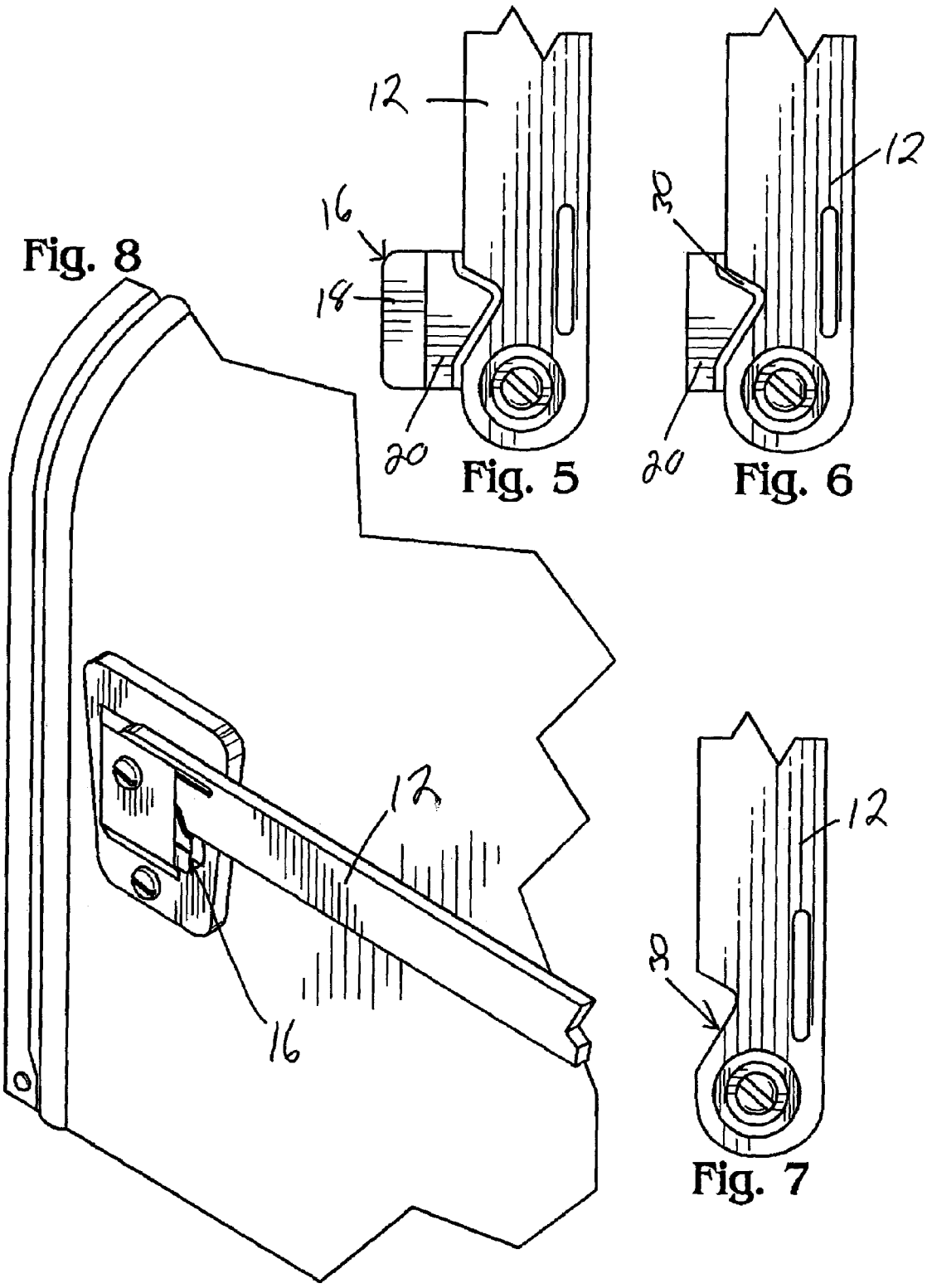
FIG. 5 shows an aspect of the present invention.
FIG. 6 shows another aspect of the present invention.
FIG. 7 shows another aspect of the present invention.
FIG. 8 shows an embodiment of the present invention installed on a mailbox.

In the preferred embodiment, stem 12 is an elongated flat plastic strip having on one end a mounting aperture 14, and on the other end a flag portion 24 that can be adapted to individual designs. Said aperture 14 is of a diameter large enough to accommodate the insertion of the screw, bolt, or axle from an existing mailbox flag mount. To adapt said aperture 14 to accept, screws, bolts, or axles of varying diameters, a detachable bushing 22 is provided. Stem 12 has attached to it a detachable bushing 22, preferably connected by two breakable plastic connectors 26, 28. As shown in FIG. 2, detachable bushing 22 when detached can fit within mounting aperture 14. Said bushing 22 has an outside diameter approximately equal to the inside diameter of said aperture 14. As shown in FIG. 4, bushing is inserted into aperture 14, and then the existing screw, bolt, or axle from the mailbox on which the flag is being mounted inserts through bushing 22. Where screw from mailbox is larger than the bushing 22, the bushing 22 is not used. As shown in FIGS. 5–7, stem 12 has attached to it a stop tab 16 which can be detached in segments 18, 20, by breaking off first segment 18 and leaving second segment 20 as shown in FIG. 6, or by breaking off the entire stop tab, as shown in FIG. 7. Second segment 20 is scored from the stem leaving a notch 30 in the stem as shown in FIGS. 6–7. To facilitate breaking off the first and second segments, 18 and 20, the stop tab 16 is scored to make break lines. When flag is moved from the vertical position to the horizontal, shown in FIG. 8, the stop tab 16 stops the flag from descending below the horizontal, an approximately ninety degree arc swing. User detaches stop tab 16 segments 18, 20 as determined by the mailbox mount so that when the flag is mounted, it stops its arc swing at the horizontal. Stop tab segments 18, 20 are removed as needed depending on the mailbox mount. FIG. 8 shows a mailbox mount where the entire stop tab 16 is left attached. The horizontal is a line parallel to the bottom edge of the mailbox, perpendicular to the front edge of the mailbox. Ideally the carrier signal flag should retract from the upright to a horizontal position with the leading edge of the flag stem being parallel to the top of the mailbox. Certain mailboxes mounts will require detaching the entire stop tab 16 so that the flag can be lowered to the horizontal. The notch 30 is provided for mailboxes which have mounts which would interfere with complete lowering of the flag. The present invention is preferably made of plastic and is plastic injection molded.

For the preferred dimensions, the flag portion 24 is 2.5 inches (6.35 cm) by 4.125 inches (10.4775 cm) by 0.125 inches (0.3175 cm), the stem 12, not including the portion of the stem taken up by the flag portion, is 7.5 inches (19.05 cm) by 0.750 inches (1.905 cm) by 0.125 inches (0.3175 cm), the mounting aperture 14 has an inside diameter of 0.375 (0.9525 cm), the bushing 22 has an outside diameter of 0.375 inches (0.9525 cm), a width of 0.188 inches (0.47752 cm), and an inside diameter of 0.200 inches (0.508 cm), and the stop tab 16 extends out from the stem by 0.438 inches (1.11252 cm) with a width of 0.125 inches (0.3175 cm).

In the preferred operation, the replacement flag 10 is mounted on a mailbox by breaking the detachable bushing 22 connector tabs 26, 28 and inserting, as needed, the bushing 22 into the mounting aperture 14. The screw, bolt, or axle of the existing mailbox mount from the existing flag on the mailbox is then inserted through the mailbox mount and through the mounting aperture 14 and, as needed, the bushing 22, to connect to the mailbox mount. Where required the detachable stop tab 16 segments 18, 20 are removed so that when the replacement flag 10 is lowered to the horizontal, it stops at the horizontal without lowering further. This stop point, at which the flag stops at the horizontal, is unique to each manufacturer's mounting bracket and specific to the original equipment flag stem's width and/or contour. The provided removable first and second segments 18 and 20, allow the user to tailor the replacement flag 10 to mounts having differing stop points to ensure that the replacement flag when lowered stops at the horizontal.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. A one-piece replacement mailbox signal flag for a mailbox, comprising:

a stem having a mounting aperture and a flag portion attached to the distal end of said stem in relation to the mounting aperture;

a detachable stop tab attached to said stem; and a detachable bushing connected to said stem by two breakable plastic connectors.

2. A one-piece replacement mailbox signal flag for a mailbox, comprising:

a stem having a mounting aperture;

a two part detachable stop tab attached to said stem;

a detachable bushing connected to said stem by two breakable plastic connectors; and a flag portion attached to the distal end of said stem in relation to the mounting aperture.

3. A one-piece replacement mailbox signal flag for a mailbox, comprising:

a stem having a mounting aperture and a flag portion attached to the distal end of said stem in relation to the mounting aperture;

a two part detachable stop tab, the first part breakably connected to said stem and the second part breakably connected to said first part; and a detachable bushing breakably connected to said stem.

* * * * *